US005793346A

United States Patent [19]

Moon

[11] Patent Number: 5,793,346

[45] Date of Patent: Aug. 11, 1998

[54] LIQUID CRYSTAL DISPLAY DEVICES HAVING ACTIVE SCREEN CLEARING CIRCUITS THEREIN

[75] Inventor: Seung-Hwan Moon, Seoul, Rep. of Korea

[73] Assignee: Samsung Electronics Co., Ltd., Suwon, Rep. of Korea

[21] Appl. No.: 708,186

[22] Filed: Sep. 6, 1996

[30] Foreign Application Priority Data

Sep. 7, 1995 [KR] Rep. of Korea ..... 1995-29444

[51] Int. Cl.[6] ..... G09G 3/36; G09G 5/00

[52] U.S. Cl. ..... 345/92; 345/211; 345/214

[58] Field of Search ..... 345/90–93, 204, 345/205, 211–215, 52, 100; 365/228, 229

[56] References Cited

U.S. PATENT DOCUMENTS

| | | | |
|---|---|---|---|
| 4,422,163 | 12/1983 | Oldenkamp | 365/229 |
| 5,248,963 | 9/1993 | Yasui et al. | 345/211 |
| 5,430,460 | 7/1995 | Takabatake et al. | 345/96 |
| 5,448,384 | 9/1995 | Uchino et al. | 345/92 |
| 5,526,012 | 6/1996 | Shibahara | 345/92 |
| 5,572,735 | 11/1996 | Tanikawa | 345/211 |

FOREIGN PATENT DOCUMENTS

| | | |
|---|---|---|
| 0 364 590 A1 | 4/1990 | European Pat. Off. . |
| 0 605 846 A1 | 7/1994 | European Pat. Off. . |

*Primary Examiner*—Steven J. Saras
*Assistant Examiner*—David L. Lewis

[57] ABSTRACT

A circuit and method of clearing a thin film transistor liquid crystal display (TFT LCD) when the external power is removed from the liquid crystal display. The screen clearing circuit consists of a power shut-off detection circuit and discharge circuit which operates to discharge the liquid crystal capacitors and support capacitors when the power is removed from the TFT LCD. The circuit consists of a diode and capacitor connected to a PMOS transistor, in which the diode and capacitor detect a power shut-off, thereby turning on a PMOS transistor so as to form a discharge path to ground for the liquid crystal and support capacitors. The TFT LCD screen is cleared when the capacitors are discharged, thereby eliminating a residual image when the power is turned off.

3 Claims, 4 Drawing Sheets

LIQUID CRYSTAL DISPLAY DEVICES HAVING ACTIVE SCREEN CLEARING CIRCUITS THEREIN

FIELD OF THE INVENTION

The present invention is a screen clearing circuit for a thin film transistor liquid crystal display (hereinafter referred to as a TFT LCD), and a method of clearing the screen. Specifically, it is a circuit and method of clearing a TFT LCD when the external power is removed from the liquid crystal display.

DESCRIPTION OF PRIOR ART

The prior art will be described below in conjunction with the accompanying drawings, in which:

FIG. 1 is an equivalent circuit of the gate structure of a prior art TFT LCD;

FIG. 2 is a diagram of the current-voltage characteristic curve of a prior art thin-film transistor in a TFT LCD; and FIG. 3 is a diagram which shows the typical prior art voltage waveforms (a) and (b) applied to the gates of the TFTs in a TFT LCD.

Each dot of a pixel in a TFT LCD comprises a thin-film transistor, a liquid crystal capacitor Clc, and a support capacitor Cst.

As shown in FIG. 1, when a TFT is turned on, a liquid crystal capacitor Clc receives the voltage applied to the source electrode of the TFT, and the liquid crystal is switched to a contrast mode. Referring to FIG. 3, it can be seen that the TFTs connected to the gate lines are sequentially turned on by voltage Von applied to the gate line, and then turned off by a voltage Voff applied to the gate line. After the desired voltage is supplied to the liquid crystal capacitor Clc, the TFT is turned off during one frame to prevent the charges in the liquid crystal capacitor Clc from leaking out through the TFT, in order to maintain the contrast in the liquid crystal.

In FIG. 1, it can be seen that a support capacitor Cst is charged at the same time that liquid crystal capacitor Clc is charged. Support capacitor Cst supplies a charge to compensate for the leakage of charge from the liquid crystal capacitor Clc during the time period when the associated TFT is turned off by voltage Voff applied to the gate of the TFT. Accordingly, the circuit operation prevents excessive discharge of the liquid crystal capacitor Clc, thereby allowing stable contrast during one frame.

FIG. 2 shows a typical current-voltage characteristic of a TFT. Referring to FIGS. 2 and 3, when voltage Von is applied to the gate electrode of a TFT, the current Ion flows through the TFT to cause the voltage at the source electrode to be applied to the liquid crystal capacitor Clc. When voltage Voff is applied to the gate of the TFT, current through the TFT is greatly restricted to a level Ioff, thereby preventing the leakage of charge stored in the liquid crystal capacitor Clc. Typically, voltage Von is greater than 20V and voltage Voff is less than −2V.

The prior art circuit described above has a latching problem when power is removed from the TFT LCD. Immediately before the power supply is removed from a TFT LCD, voltage Voff is applied to the gate electrodes of most of the TFTs, and voltage Voff is stored in the associated support capacitors Cst. This causes a latching situation with respect to the TFTs and associated capacitors in that the charge in the capacitor Cst maintains the TFT in the "off" condition, thereby preventing discharge of capacitor Cst.

Therefore, the display screen of the TFT LCD remains on and it retains an image after the power supply is turned off. The control circuitry of a prior art TFT LCD does not allow the display screen to be cleared quickly, thereby resulting in the display of a residual image. This may cause the user of such a TFT LCD to have an unfavorable impression about the product quality.

SUMMARY OF THE INVENTION

It is an object of the invention to provide a screen clearing circuit and method for a TFT LCD, in which the screen is cleared quickly after the power is shut off.

It is a further object of the invention to provide a circuit and method for quickly discharging the support capacitors in a TFT LCD after the power is shut off.

In order to attain the above objects, this invention comprises:

a capacitor of which one end is connected to the external power;

a diode of which the anode is connected to the other end of said capacitor, and the cathode is grounded; and a PMOS transistor of which the gate electrode is connected to the anode of said diode and the other end of said capacitor, the source electrode is grounded, and the drain electrode is connected to one end of a support capacitor of a TFT LCD.

In order to attain the above objects, the present invention also comprises the following steps:

detecting whether external power has been shut off;

charging the support capacitor if the external power is not shut off, and then returning to the first detecting step;

discharging the support capacitor if the external power is shut off, and then returning to the first detecting step.

DETAILED DESCRIPTION OF THE PREFERRED EMBODIMENTS

The preferred embodiments of the present invention are described below in detail in conjunction with the accompanying drawings.

Figure 1:
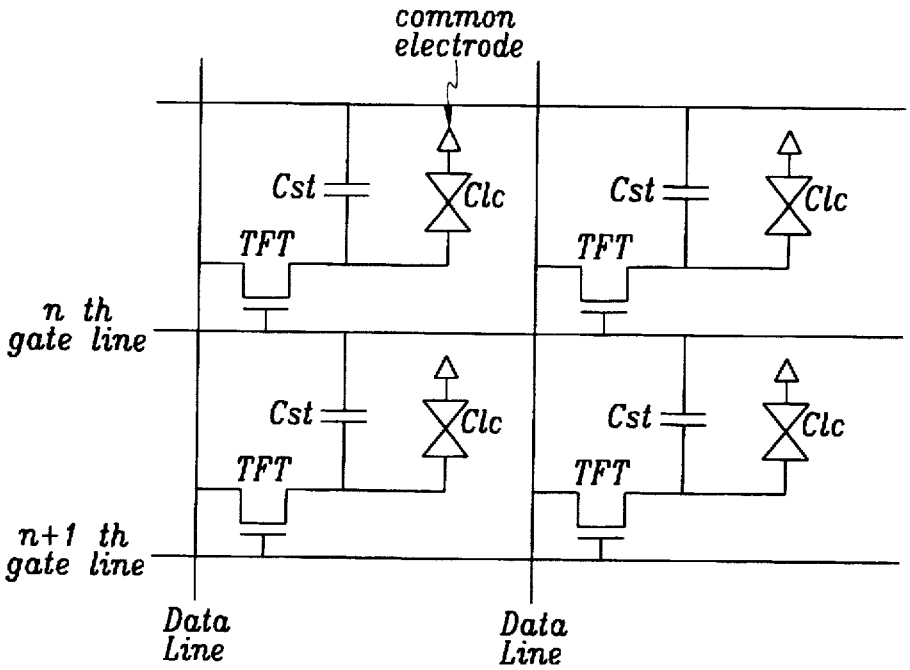
FIG. 1 (Prior Art)
FIG. 1 is an equivalent circuit of the gate structure of a typical prior art LCD.
Figure 2:
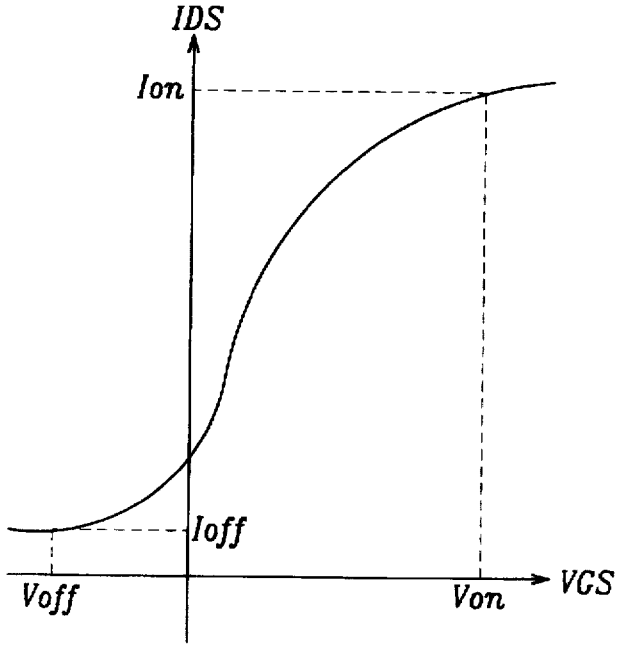
FIG. 2 (Prior Art)
FIG. 2 is a diagram of the current-voltage characteristic curve of a prior art thin-film transistor in a TFT LCD.
Figure 3:
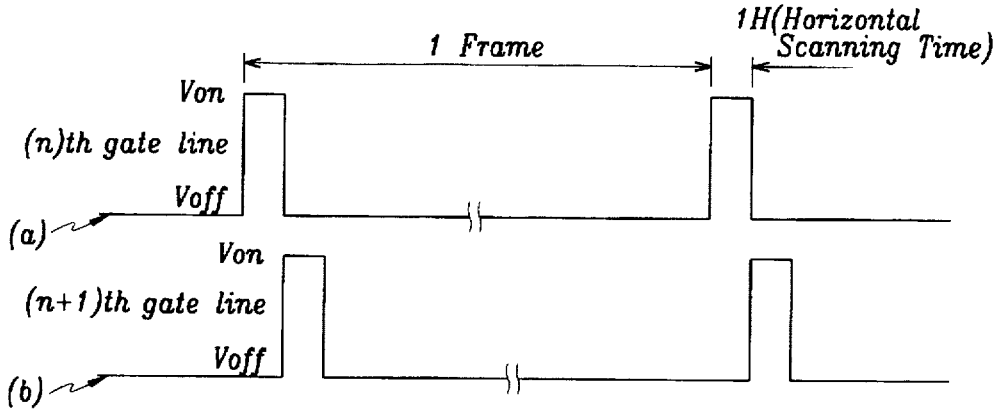
FIG. 3 (Prior Art)
FIG. 3 is a diagram which shows the typical prior art voltage waveforms applied to the gates of the TFTs in a TFT LCD.
Figure 4:
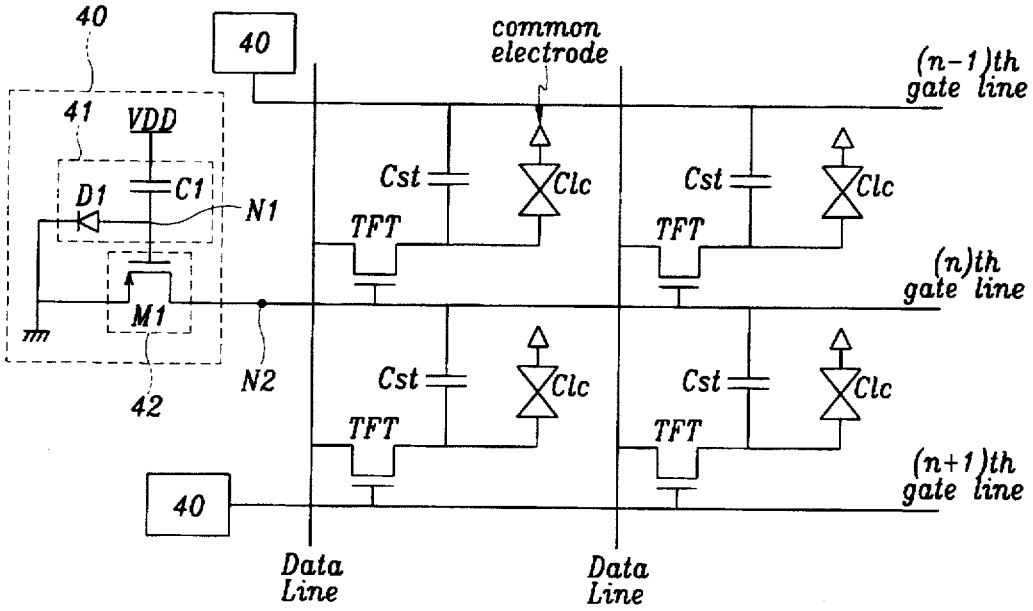
FIG. 4 is a screen clearing circuit according to an embodiment of the present invention.

FIG. 4 shows a screen clearing circuit 40 according to an embodiment of the present invention. The screen clearing circuit 40 is connected to each gate line in the TFT LCD. The screen clearing circuit 40 is inactive when external power VDD is being applied, but when VDD is shut off, the circuit operates to discharge the support capacitor Cst.

In FIG. 4, the cathode of D1 is grounded, and the anode of D1 is connected through a first node N1 to one end of the capacitor C1, which has its other end connected to external power VDD. The source electrode of PMOS transistor M1 is grounded, and the drain electrode of PMOS transistor M1 is connected to one end of support capacitor Cst. The other end of support capacitor Cst is connected to the drain electrode of a TFT in the TFT LCD. The gate electrode of PMOS transistor M1 is connected to the first node N1.

Figure 5:
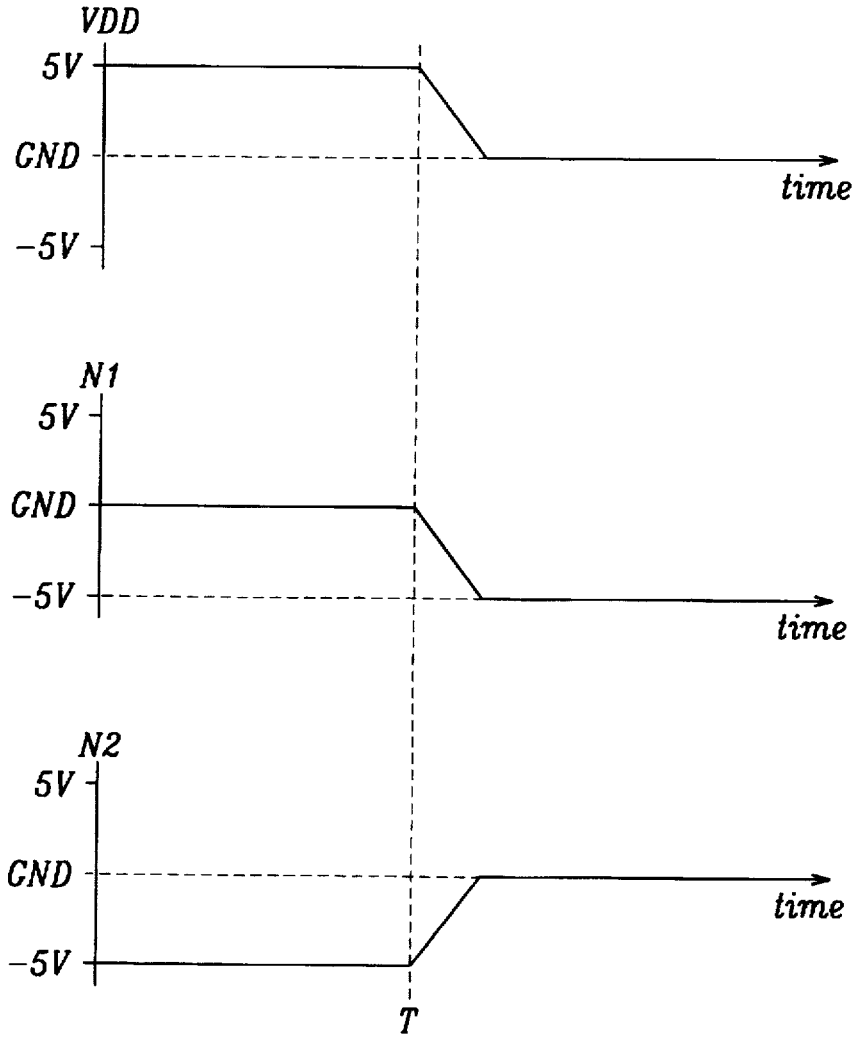
FIG. 5 shows the voltage waveforms of VDD, N1 and N2 in a screen clearing circuit operating according to an embodiment of the present invention.

Referring to FIGS. 4 and 5, the external power VDD is applied before time T (in FIG. 5), and the first node N1 becomes approximately ground level voltage GND through the diode D1 (ignoring the voltage drop through D1), and at the same time, capacitor C1 is charged with the following quantity of charge Q1:

$$Q1=C1*(GND-VDD) \quad (1)$$

Assuming that VDD is 5V and GND is 0V:

$$Q1=C1*(-5V) \quad (1a)$$

Therefore:

$$Q1/C1=(-5V) \quad (1b)$$

After time T (in FIG. 5), when the external power VDD is shut off, VDD becomes the ground level voltage 0V, and the following voltage level V1 appears at the first node N1:

$$V1=Q1/C1+GND \quad (2)$$

From equation (1b) above, Q1/C1=(−5V), and the voltage V1 at node N1 becomes:

$$V1=(-5V) \quad (2a)$$

When the voltage V1 at node N1 is (−5V), PMOS transistor M1 is turned on, thereby discharging support capacitor Cst, as explained more fully below.

The capacitor C1 and diode D1 constitute a power shut-off detecting circuit 41, which detects whether external power VDD is being supplied. Node N1 shows a ground level 0V when external 5V power VDD is being supplied, while it shows (−5V), the opposite polarity of the external power, when the external power is shut off. The voltage at node N1 controls the PMOS transistor M1 so as to discharge the support capacitor Cst when the external power is shut off.

In FIG. 4, when the voltage level of node N1 is 0V, then the gate-source voltage Vgs is greater than the threshold voltage Vth (Vgs>Vth) of the PMOS transistor M1, transistor M1 is turned off and it exerts no influence on support capacitor Cst. When the external power VDD is shut off, the voltage level V1 of node N1 becomes −5V and Vgs<Vth, thereby turning on PMOS transistor M1 and discharging support capacitor Cst to ground GND. Accordingly, the GND voltage level is applied to the gates of the TFTs, thereby turning off the LCD display by providing a path to discharge the liquid crystal capacitor Clc and the support capacitor Cst electrically coupled thereto. Discharging the support capacitor Cst and liquid crystal capacitor Clc eliminates the residual image on the TFT LCD.

In FIG. 4, power shut-off detecting circuit 41 consists of capacitor C1 and diode D1, which detect whether external power VDD is being supplied. In this embodiment, diode D1 is provided as a reference voltage setting means which supplies a predetermined voltage to the gate of the PMOS transistor M1. A resistor could also be used as the reference voltage setting means without floating the voltage of the gate of transistor M1. Also in this embodiment, PMOS transistor M1 operates as a switching means 42. A separate power shut-off detecting circuit is not required for each switching means. A plurality of switching means may be controlled by a single power shut-off detecting circuit. Alternatively, instead of connecting one end of the support capacitor Cst to an adjacent gate line, one end of all the support capacitors Cst could be connected to a support capacitor line which is formed separately from the gate lines. In this way, the screen clearing circuit 40 can switch the support capacitor line to ground, thereby discharging the support capacitors. Other equivalent means having the same functions may be used within the spirit and scope of this invention.

Figure 6:
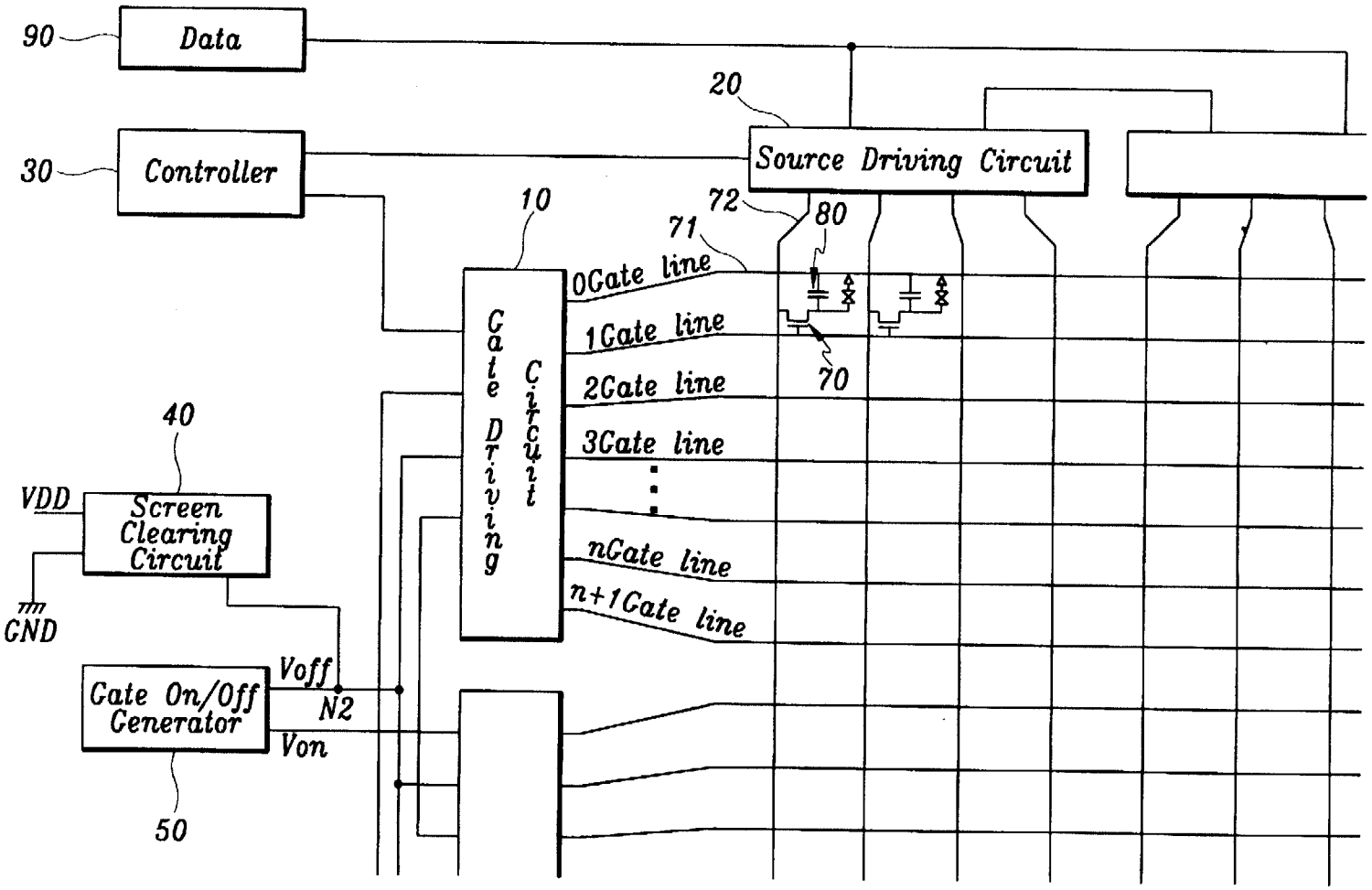
FIG. 6 is an embodiment of the invention which shows the screen clearing circuit illustrated in FIG. 4, connected to a different portion of the TFT LCD circuitry.

FIG. 6 shows the screen clearing circuit 40 connected at an input to the gate driving circuit 10, as opposed to the direct connection to the gate lines shown in FIG. 4. The controller 30 controls the source driving circuit 20, which, based on the image data 90, supplies data voltage through data lines 72 to each pixel electrode (TFT source electrode), thereby rearranging the orientation of the liquid crystal according to the data voltage, in coordination with the gate-on voltage supplied to a gate line. Controller 30 also controls gate driving circuit 10, which supplies gate on/off voltages sequentially through the gate lines to the thin film transistors 70. The gate on/off generator 50 generates the Voff and Von voltages which are sent to the gate lines by the gate driving circuit 10. The screen clearing circuit 40 is connected to the Voff output of gate on/off generator 50. When the external power is disconnected, the screen clearing circuit 40 operates to discharge the storage capacitors 80 connected to the gate lines. This embodiment requires only one screen clearing circuit 40, whereas the embodiment in FIG. 4 requires a separate screen clearing circuit for each gate line.

Elimination of the residual image improves the quality of TFT LCDs. This invention may be used in a wide variety of display devices such as notebook computers, handheld devices, and flat panel television screens.

What is claimed is:

1. A liquid crystal display device, comprising:

a plurality of data lines;

a plurality of thin-film transistor (TFT) liquid crystal display cells electrically coupled to said plurality of data lines and arranged as a first string of TFT display cells electrically coupled together by a first gate line and a second string of TFT display cells electrically coupled together by a second gate line, said second string of TFT display cells comprising respective support capacitors therein electrically coupled to said first gate line; and a screen clearing circuit electrically coupled to said first gate line and comprising a charge pump, to turn off said first string of TFT display cells irrespective of the potentials of said plurality of data lines, by driving said first gate line to a ground reference potential and discharging said support capacitors electrically coupled thereto upon termination of a power signal;

wherein each of said TFT display cells in said first string thereof comprises a pixel electrode, a support capacitor electrically coupled to said pixel electrode, a source region electrically coupled to one of said plurality of data lines, a drain region electrically coupled to said pixel electrode and a gate electrically coupled to said first gate line:

wherein said screen clearing circuit comprises a pass transistor electrically coupled in series between said first gate line and a reference signal line; and wherein said pass transistor has a gate electrically coupled to said charge pump.

2. The display device of claim 1, wherein said charge pump comprises:

a capacitor electrically coupled in series between a power signal line and said gate of said pass transistor; and a diode electrically coupled in series between said gate of said pass transistor and the reference signal line.

3. The display device of claim 2, wherein the pass transistor comprises a PMOS transistor; and wherein an anode of said diode is electrically connected to said gate of said PMOS transistor.

* * * * *